US008057621B2

(12) United States Patent
Kohler

(10) Patent No.: US 8,057,621 B2
(45) Date of Patent: Nov. 15, 2011

(54) APPARATUS AND METHOD FOR PRODUCING A CORRUGATED PRODUCT UNDER AMBIENT TEMPERATURE CONDITIONS

(76) Inventor: Herbert B. Kohler, Uniontown, OH (US)

( * ) Notice: Subject to any disclaimer, the term of this patent is extended or adjusted under 35 U.S.C. 154(b) by 474 days.

(21) Appl. No.: 11/279,347

(22) Filed: Apr. 11, 2006

(65) Prior Publication Data

US 2006/0225830 A1 Oct. 12, 2006

Related U.S. Application Data

(60) Provisional application No. 60/670,505, filed on Apr. 12, 2005.

(51) Int. Cl.
*B31F 1/22* (2006.01)
*B31F 1/36* (2006.01)

(52) U.S. Cl. ..... 156/205; 156/472; 156/497; 156/361

(58) Field of Classification Search ..... None
See application file for complete search history.

(56) References Cited

U.S. PATENT DOCUMENTS

| | | | | |
|---|---|---|---|---|
| 1,848,583 | A * | 3/1932 | Swift, Jr. | 156/205 |
| 1,981,338 | A | 11/1934 | Swift, Jr. | |
| 2,398,844 | A | 4/1946 | Muggleton et al. | |
| 2,622,558 | A | 12/1952 | Mikkelsen | |
| 3,026,231 | A | 3/1962 | Chavannes | |
| 3,046,935 | A | 7/1962 | Wilson | |
| 3,178,494 | A | 4/1965 | Tisdale | |
| 3,300,359 | A | 1/1967 | Nikkel | |
| 3,303,814 | A | 2/1967 | Nitchie | |
| 3,306,805 | A | 2/1967 | Klein et al. | |
| 3,383,234 | A | 5/1968 | Nikkel | |
| 3,479,240 | A | 11/1969 | Moser | |
| 3,560,310 | A | 2/1971 | Bolton | |

(Continued)

FOREIGN PATENT DOCUMENTS

| | | |
|---|---|---|
| CA | 1072873 | 3/1980 |

(Continued)

OTHER PUBLICATIONS

E. Daub, et al., "Gluing Corrugating Medium and Linerboard Together on the Corrugator," *Tappi Journal*, pp. 171-178, Jun. 1990.

(Continued)

*Primary Examiner* — John L. Goff
*Assistant Examiner* — Barbara J. Musser
(74) *Attorney, Agent, or Firm* — Pearne & Gordon LLP

(57) ABSTRACT

A method and apparatus are useful to produce a corrugated product. They can be used to produce a corrugated product at low temperature, such as room temperature. A zero-contact roll is used to support a web of medium material on a cushion of air at a location prior to the web entering the corrugating labyrinth. The web is free to move toward or away from the surface of the zero-contact roll, on the cushion of air, in response to small oscillatory changes in downstream tension demand based on the fluting frequency in the corrugating labyrinth. A mechanism is also provided to precisely control the mean tension in the web prior to entering the corrugating labyrinth at a low value. Thus, mean web tension is precisely controlled and is low, tension oscillations can be damped, and low temperature corrugating can be achieved without significant fracturing in the corrugated web. A single-facer useful to apply a high-solids content adhesive, also desirable for low-temperature corrugating, is also provided.

34 Claims, 9 Drawing Sheets

U.S. PATENT DOCUMENTS

| | | | | |
|---|---|---|---|---|
| 3,648,913 | A | 3/1972 | Ferara | |
| 3,676,247 | A * | 7/1972 | Morris et al. | 156/205 |
| 3,700,518 | A | 10/1972 | Ohmori | |
| 3,773,587 | A | 11/1973 | Flewwelling | |
| 3,788,515 | A | 1/1974 | Middleman | |
| 3,981,758 | A | 9/1976 | Thayer et al. | |
| 4,086,116 | A | 4/1978 | Yazaki et al. | |
| 4,104,107 | A | 8/1978 | Christensen | |
| 4,134,781 | A | 1/1979 | Carstens et al. | |
| 4,177,102 | A | 12/1979 | Tokuno | |
| 4,267,008 | A | 5/1981 | Owens | |
| 4,282,998 | A * | 8/1981 | Peekna | 242/615.12 |
| 4,306,932 | A | 12/1981 | Bradatsch et al. | |
| 4,316,428 | A | 2/1982 | Flaum et al. | |
| 4,316,755 | A | 2/1982 | Flaum et al. | |
| 4,338,154 | A | 7/1982 | Berthelot et al. | |
| 4,344,379 | A | 8/1982 | Roberts | |
| 4,351,264 | A | 9/1982 | Flaum et al. | |
| 4,453,465 | A | 6/1984 | Heller et al. | |
| 4,544,436 | A | 10/1985 | Itoh et al. | |
| 4,569,864 | A | 2/1986 | McIntyre | |
| 4,589,944 | A | 5/1986 | Torti et al. | |
| 4,603,654 | A | 8/1986 | Mori et al. | |
| 4,757,782 | A | 7/1988 | Pullinen | |
| 4,764,236 | A | 8/1988 | Nikkel | |
| 4,806,183 | A | 2/1989 | Williams | |
| 4,841,317 | A | 6/1989 | Westell | |
| 4,863,087 | A | 9/1989 | Kohler | |
| 4,871,593 | A | 10/1989 | McIntyre | |
| 4,879,949 | A | 11/1989 | Vennike | |
| 4,886,563 | A | 12/1989 | Bennett et al. | |
| 4,935,082 | A | 6/1990 | Bennett et al. | |
| 4,991,787 | A | 2/1991 | Berg | |
| 5,016,801 | A | 5/1991 | Gilat et al. | |
| 5,037,665 | A | 8/1991 | LaMantia et al. | |
| 5,048,453 | A | 9/1991 | Eriksson | |
| 5,103,732 | A | 4/1992 | Wells et al. | |
| 5,203,935 | A | 4/1993 | May et al. | |
| 5,226,577 | A | 7/1993 | Kohler | |
| 5,242,525 | A | 9/1993 | Biagiotti | |
| 5,246,497 | A | 9/1993 | Rantanen | |
| 5,275,657 | A | 1/1994 | Duffy et al. | |
| 5,362,346 | A | 11/1994 | Bullock, Sr. | |
| 5,503,547 | A | 4/1996 | Funahashi et al. | |
| 5,508,083 | A | 4/1996 | Chapman, Jr. | |
| 5,656,124 | A | 8/1997 | Krayenhagen et al. | |
| 5,660,631 | A | 8/1997 | Eriksson | |
| 5,783,006 | A | 7/1998 | Klockenkemper et al. | |
| 5,785,802 | A | 7/1998 | Seki et al. | |
| 6,051,068 | A | 4/2000 | Kohl et al. | |
| 6,058,844 | A | 5/2000 | Niemiec | |
| 6,068,701 | A | 5/2000 | Kohler et al. | |
| 6,098,687 | A * | 8/2000 | Ishibuchi et al. | 156/473 |
| 6,126,750 | A | 10/2000 | Seiz et al. | |
| 6,136,417 | A | 10/2000 | Ishibuchi et al. | |
| 6,155,319 | A | 12/2000 | Giugliano et al. | |
| 6,257,520 | B1 | 7/2001 | Fujikura | |
| 6,364,247 | B1 * | 4/2002 | Polkinghorne | 242/615.11 |
| 6,418,851 | B1 | 7/2002 | Hartmann et al. | |
| 6,470,294 | B1 | 10/2002 | Taylor | |
| 6,575,399 | B1 | 6/2003 | Lamothe | |
| 6,595,465 | B2 | 7/2003 | Lamothe | |
| 6,602,546 | B1 | 8/2003 | Kohler | |
| 6,620,455 | B2 | 9/2003 | Mensing et al. | |
| 6,635,111 | B1 | 10/2003 | Holtmann et al. | |
| 6,692,602 | B1 | 2/2004 | Mensing et al. | |
| 6,800,052 | B1 | 10/2004 | Abe | |
| 7,267,153 | B2 | 9/2007 | Kohler | |
| 2002/0149866 | A1 * | 10/2002 | Kato et al. | 360/13 |
| 2003/0178524 | A1 | 9/2003 | Newman et al. | |
| 2004/0241328 | A1 | 12/2004 | Bradatsch et al. | |
| 2005/0194088 | A1 | 9/2005 | Kohler | |
| 2007/0098887 | A1 | 5/2007 | Kohler | |
| 2007/0261793 | A1 | 11/2007 | Kohler | |

FOREIGN PATENT DOCUMENTS

| | | | |
|---|---|---|---|
| DE | 4018426 | | 12/1991 |
| EP | 0037332 | | 10/1981 |
| EP | 0825017 | | 2/1998 |
| EP | 1199151 | A2 | 4/2002 |
| EP | 1199152 | A2 | 4/2002 |
| GB | 1544634 | | 4/1979 |
| JP | S40-023188 | U | 8/1965 |
| JP | S42-004916 | B | 2/1967 |
| JP | S56-160832 | | 11/1981 |
| JP | H01-228572 | A | 9/1989 |
| JP | 2000202930 | | 7/2000 |
| JP | 2001-063918 | A | 3/2001 |
| JP | 2002-192637 | A | 7/2002 |
| JP | 2005-193504 | | 7/2005 |

OTHER PUBLICATIONS

Clyde H. Sprague, "Development of a Cold Corrugating Process Final Report," The Institute of Paper Chemistry, for the Office of Industrial Programs, U.S. Department of Energy, May 1985 (total of 718 pages for Sections I-V).

William O. Kroeschell, "Bonding on the corrugator," Tappi Journal, Feb. 1990, pp. 69-74.

Ononokpono et al., "The influence of binder film thickness on the mechanical properties of binder films in tension," J. Pharm Pharmacol., Feb. 1988, pp. 126-128.

M. Inoue et al., "Kinetics of Gelatinization of Cornstarch Adhesive," J. of Applied Polymer Science, 1986, pp. 2779-2789, vol. 31.

Raymond L. Janes, "A Study of Adhesion in the Cellulose-Starch-Cellulose System," The Institute of Paper Chemistry, Jun. 1968, Appleton, WI.

"Development of a Cold Corrugating Process," Contract No. DE-AC02-79CS40211, The Institute of Paper Chemistry, Dec. 15, 1981, Appleton, WI.

International Search Report and Written Opinion, from corresponding PCT Application Serial No. PCT/US2006/013578.

International Search Report, Written Opinion and International Preliminary Report on Patentability, from PCT Application Serial No. PCT/US2005/001925.

International Search Report, Written Opinion and International Preliminary Report on Patentability, from PCT Application Serial No. PCT/US2006/035474.

International Search Report and Written Opinion, from PCT Application Serial No. PCT/US2008/067519.

European Search Report from European Application No. 03100620.8 (European application corresponding to U.S. Appl. No. 10/176,890).

Prosecution history for U.S. Appl. No. 11/259,794.

Herbert Kohler, "Cold Corrugating" Presentation.

ELTEX Elektrostatik GMBH, "Webmoister 70XR" Presentation.

Page from a brochure for the Marquip Pyrobond Singlefacer.

Office action issued in corresponding Canadian patent application No. 2,604,142, dated Jun. 19, 2009.

Printco Industries, LLC, "Chambered Reverse Angle Doctor Blade System," retrieved from www.printco-industries.com on Sep. 25, 2009.

Whitsitt, W.J. et al., "High Speed Runnability and Bonding: Effects of Medium and Corrugator Conditions on Board Quality," Institute of Paper Chemistry, Appleton, WI, May 1, 1989.

International Search Report and Written Opinion from PCT Application PCT/US09/37959, issued Aug. 31, 2009.

Notice of Rejection issued Sep. 29, 2009 in Japanese Patent Application No. 2007-501779.

International Search Report and Written Opinion issued May 18, 2010 in PCT Application Serial No. PCT/US10/21753.

Shaw, N.W. et al., "Xitex—A revolution in board design and manufacture," Tappi Journal 1997 Corrugated Containers Conference Proceedings.

Office action issued in corresponding Canadian patent application No. 2,604,142, dated Aug. 3, 2010.

* cited by examiner

APPARATUS AND METHOD FOR PRODUCING A CORRUGATED PRODUCT UNDER AMBIENT TEMPERATURE CONDITIONS

This application claims the benefit of U.S. provisional patent application Ser. No. 60/670,505 filed Apr. 12, 2005, the contents of which are incorporated herein by reference.

BACKGROUND OF THE INVENTION

Conventional corrugating methods and machinery for making corrugated board employ a significant amount of heat energy in the form of steam at various stages of the corrugating process. For example, steam heat is used to heat the corrugating rollers to lower the coefficient of friction. This is so the medium that is drawn and formed into a corrugated web between those rolls is not unduly stressed or fractured due to friction-induced over-tensioning of the medium in the corrugating labyrinth.

A substantial amount of energy often also is used to preheat a face-sheet web prior to entering the single-facer or the double-backer. In each of these machines, a face-sheet web is adhered to one side of a corrugated web by contacting the face sheet with crests of respective corrugations (sometimes called "flutes") located on one side of the corrugated web where a conventionally low-solids, high-water-content adhesive (typically 70-90% water) has been applied. The face sheets are preheated so they can more readily and uniformly absorb the high-water content adhesive on contacting the flute crests in order to form an adequate green-strength bond. These adhesives typically require additional heat to initiate a chemical change that creates the final bond. In some installations, the single-faced web (composed of a corrugated web with a first face-sheet web already adhered to one side) emerging from the single-facer also is preheated prior to entering the glue machine so the exposed flute crests will more readily absorb the high-water content adhesive, and so they will be closer to the temperature (commonly know as the gel point) that causes the chemical change to occur.

Lastly, a significant amount of heat energy is expended in the double-backer where hot plates conventionally are used to drive off excess moisture from the high-water content adhesive used to assemble the finished corrugated board. This heat cures the adhesive and provides a permanent bond.

A corrugating method that substantially reduces or eliminates the above-noted requirements for heat would significantly reduce the amount of energy expended in producing corrugated products. This would considerably lower the cost, and the associated waste, per unit of corrugated product produced.

SUMMARY OF THE INVENTION

An apparatus for producing a corrugated product is provided. The apparatus includes a zero-contact roll having an outer circumferential surface, and a pair of corrugating rollers that cooperate to define, at a nip therebetween, a corrugating labyrinth between respective and interlocking pluralities of corrugating teeth provided on the corrugating rollers. The interlocking pluralities of corrugating teeth are effective to corrugate a web of medium material that is drawn through the nip on rotation of the corrugating rollers. A web pathway for the medium material follows a path around a portion of the outer circumferential surface of the zero-contact roll and through the corrugating labyrinth between the corrugating rollers. The zero-contact roll is operable to support the web of medium material at a height above its outer circumferential surface on a cushion of air that is emitted from that surface through openings provided therein.

A method of producing a corrugated product also is provided. The method includes the steps of a) providing an apparatus that includes a zero-contact roll having an outer circumferential surface and openings provided in that surface, and a pair of corrugating rollers that cooperate to define, at a nip therebetween, a corrugating labyrinth between respective and interlocking pluralities of corrugating teeth provided on the corrugating rollers; b) emitting a volumetric flow of air from the outer circumferential surface through the holes provided in that surface; c) feeding a web of medium material along a web pathway around a portion of the outer circumferential surface such that the web is supported on a cushion of air supplied by the volumetric flow of air, thereby supporting the web on the cushion of air at a height above the outer circumferential surface as the web travels therearound along the web pathway; and d) rotating the corrugating rollers to draw the web of medium material through the nip so that the web is forced to negotiate the corrugating labyrinth after traveling around the outer circumferential surface on the cushion of air.

A single-facer for producing a corrugated product also is provided. The said single-facer includes a pair of corrugating rollers that cooperate to define, at a corrugating nip therebetween, a corrugating labyrinth between respective and interlocking pluralities of corrugating teeth provided on the corrugating rollers, wherein the interlocking pluralities of corrugating teeth are effective to corrugate a web of medium material that is drawn through the nip on rotation of the corrugating rollers, a glue applicator roller cooperating with a second one of the corrugating rollers to define a glue nip therebetween at a location along the circumference of the second corrugating roller located at a position downstream from the corrugating nip relative to a web pathway for a web of medium material through said single-facer, and a thin film metering device disposed adjacent the glue applicator roller. the thin film metering device is adapted to provide a precisely metered thin film of high-solids content adhesive onto a surface of the glue applicator roller.

DETAILED DESCRIPTION OF PREFERRED EMBODIMENTS OF THE INVENTION

Figure 1:
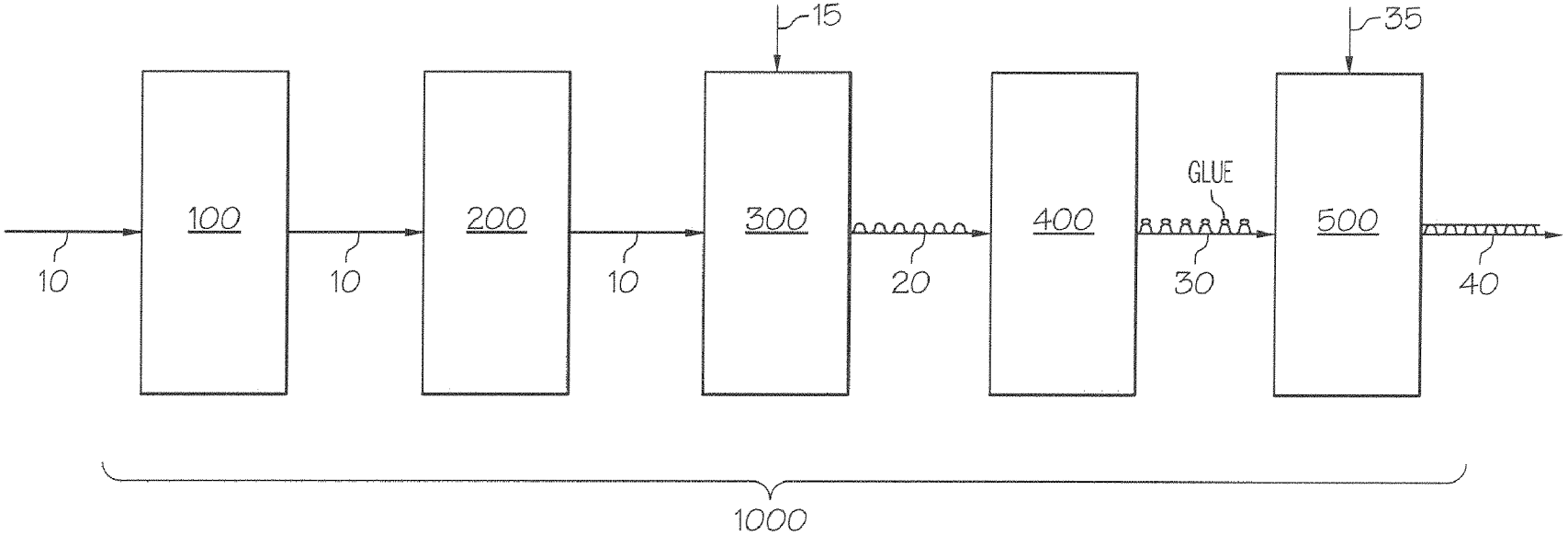
FIG. 1 is a top level schematic block diagram illustrating the process steps and associated equipment for a cold corrugating method.

A block diagram of a cold corrugating apparatus 1000 is shown schematically in FIG. 1. In the illustrated embodiment, the cold corrugating apparatus includes a medium conditioning apparatus 100, a pre-corrugating web tensioner 200, a single-facer 300, a glue machine 400 and a double-backer 500. These components are arranged in the recited order relative to a machine direction of a web of medium material 10 as it travels along a machine path through the corrugating apparatus 1000 in order to produce a finished corrugated product 40 on exiting the double-backer 500 as illustrated schematically in FIG. 1. As will become apparent, the medium material 10 will become the corrugated web to which the first and second face-sheet webs 18 and 19 will be adhered on opposite sides to produce the finished corrugated board 40. An exemplary embodiment of each of the above elements of the corrugating apparatus 1000 will now be described.

Medium Conditioning Apparatus

The medium conditioning apparatus 100 is provided to raise the moisture content of the medium material 10 prior to being fed to the single-facer 300 where it will be formed (corrugated) into a corrugated web as further explained below. Conventional medium material 10 for producing the corrugated web is supplied having an extant moisture content that can be as low as 4-5 wt. %. In the medium conditioning apparatus, the moisture content of the medium material 10 is raised to about 7-9 wt. %. A moisture content in this range provides the medium material 10 with a greater degree of elasticity or flexibility so that as the material 10 is drawn through the corrugating labyrinth 305 (explained more fully below) it is better able to stretch and withstand the tensile forces experienced therein to avoid fracturing. In addition, an elevated moisture content in the range of 7-8 or 7-9 wt. % lowers the coefficient of friction between the medium material 10 and the corrugating rollers 310, 311 so that the material 10 slides more easily against the opposing teeth of these rolls 310, 311 as it is drawn through the corrugating labyrinth 305. This aids in minimizing or preventing fracturing due to tensile over-stressing of the medium as it is drawn through the corrugating labyrinth 305 where it is formed into a corrugated web.

A web of medium material 10 is fed into the medium conditioning apparatus 100 from a source of such material such as a roll as is known in the art. On entering the medium conditioning apparatus 100, the material 10 is fed first through a pretensioning mechanism 110 and then past a moisture application roller 120 where moisture is added to the medium material 10 to adjust its moisture content in the desired range prior to exiting the medium conditioning apparatus 100.

The pretensioning mechanism 110 adjusts the tension of the medium material 10 as it contacts the moisture application roller 120 so the medium material 10 is pressed against that roller 120 with an appropriate amount of force to ensure adequate penetration into the medium material 10 of moisture supplied by the roller 120. At higher web speeds it is sometimes required or desirable to add an additional pressure roller (not shown) to lightly press the web against the moisture application roller. The amount of moisture on the surface of roller 120 is very precisely controlled in order to achieve the desired increase in moisture content for the passing medium material (e.g. from 4-5 wt. % to about 7-9 wt %). By regulating the precise amount of moisture on the roller 120 surface and the tension of the medium material 10 as it is conveyed against that roller, an appropriate amount of additional moisture can be imparted to the passing medium material to adjust its moisture content in the appropriate range. Adjustment means can be provided to regulate the amount of moisture in the cross-machine direction (longitudinal direction of the roller 120) to compensate for cross web variations in moisture created during the manufacture of the medium material 10, thus bringing cross-web moisture variation to a lower average value.

Figure 2:
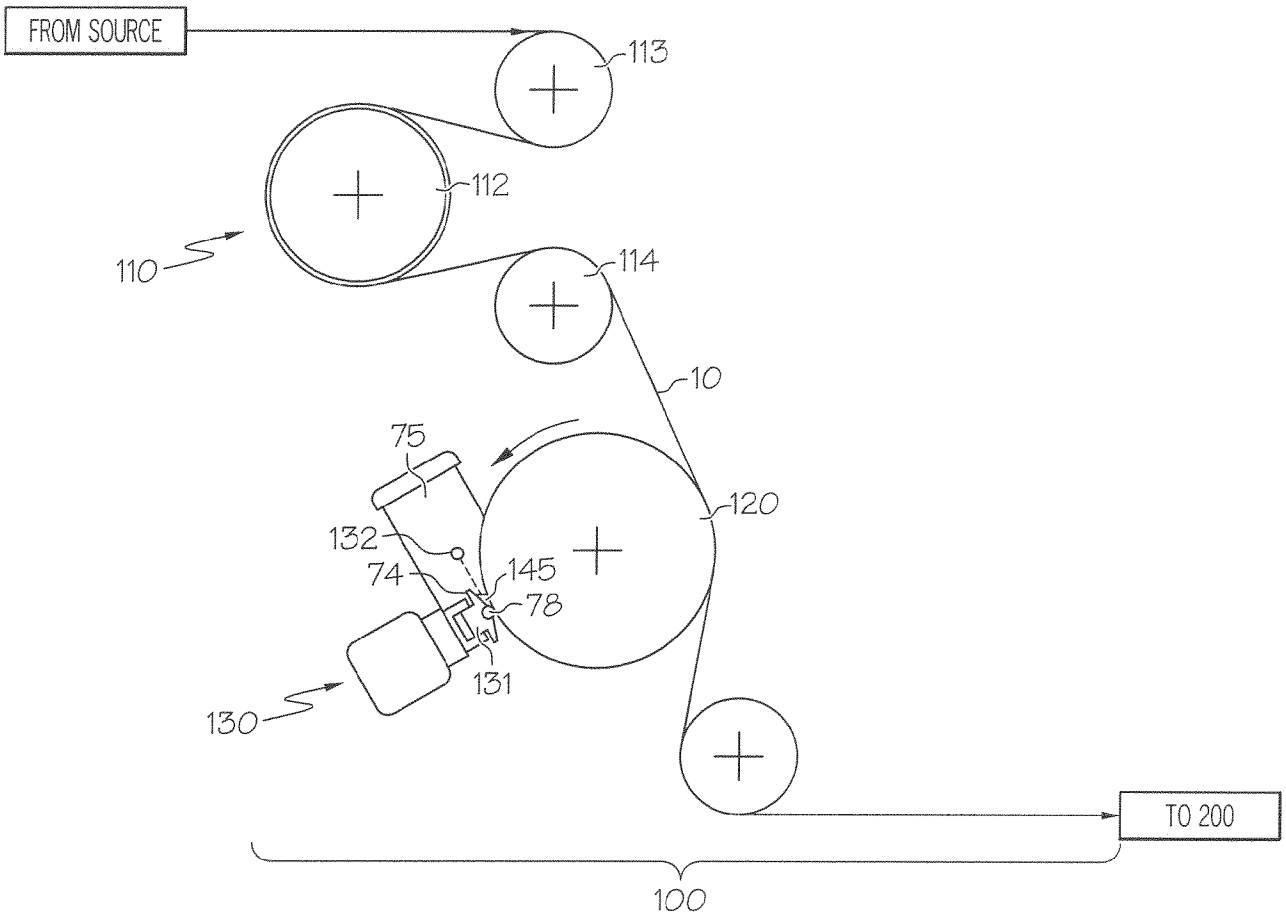
FIG. 2 is a schematic diagram of a medium conditioning apparatus that can be used in a cold corrugating method.

In the illustrated embodiment, the pretensioning mechanism 110 includes a suction roller 112 that is flanked on either side by cooperating idler rollers 113 and 114 such that the medium material 10 follows a substantially U-shaped pathway around the suction roller 112. It is preferred that the U-shaped pathway around the suction roller 112 is such that the medium material is in contact with that roller 112 around at least 50 percent of its circumference, which would result in a true "U" shape. Alternatively, and as illustrated in FIG. 2, the medium material can contact the suction roller 112 around greater than 50, e.g. at least 55, percent of its circumference resulting in the approaching and emerging portions of the web pathway relative (and tangent) to the suction roller 112 defining convergent planes as seen in the figure. Suction rollers are well known in the art and can operate by drawing the passing web against their circumferential surface through a vacuum or negative pressure produced, e.g., via a vacuum pump (not shown). The circumferential surface of the suction roller 112 is provided with a plurality of small openings or holes in order that such negative pressure will draw the medium material 10 against its circumferential surface. The force with which a passing web is drawn against the surface of a suction roller is proportional to the surface area of contact, which is the reason the idler rollers 113 and 114 are positioned to ensure contact over at least 50 percent of the suction roller's surface area.

In operation, the suction roller 112 is rotated in the same direction as the web of medium material 10 traveling over its surface, but at a slower surface linear speed than the linear speed the web 10 is traveling. In addition, the surface linear speed of the suction roller 112 is slightly slower than that of the downstream suction roller 212, which is described below. The relative difference in the surface linear speeds of these two suction rollers 112 and 212 causes an elongation of the medium material 10 between the two idler rollers 113 and 114, thereby tensioning the downstream portion of the medium material 10 on approach of the moisture application roller 120. By adjusting the radial velocity of the suction roller 112, the downstream tension in the medium material 10 can be adjusted to select an appropriate tension for producing the desired moisture content, as well as penetration of moisture, in the medium material on contacting the moisture application roller 120. One or a set of load cells provided downstream of the suction roller 112 (not shown) can be used to provide feedback control as will be understood by those of ordinary skill in the art to trim the radial velocity of the suction roller 112 to achieve a constant tension. It is recognized that an iterative process of trial and error may be desirable to discover optimal values for the surface linear speed of the moisture application roller 120, the tension in the web 10, the moisture layer thickness on the circumferential surface of the roller 120 (described below), as well as other factors to achieve a water content in the web 10 within the desired 7-9 wt. % range. For example, these and other variables may be adjusted taking into account the initial moisture content in the medium material web 10, which may vary from batch to batch, based on ambient weather conditions, production conditions, etc.

Moisture is applied to the circumferential surface of the moisture application roller 120 using a first thin film metering device 130. This device 130 is illustrated schematically in FIG. 2 and is useful to coat a very precisely metered thin film or layer 84 (FIG. 2*c*) of water onto the surface of the roller 120 from a water reservoir. The first thin film metering device 130 can be as described in U.S. Pat. Nos. 6,068,701 and 6,602,546, the contents of which are incorporated herein by reference in their entirety.

Optionally, and as disclosed in the '546 patent noted above, the metering device 130 can include a frame member and a plurality of metering rod assemblies adapted to apply varying thin film thicknesses that may be useful, e.g., where it is desirable to be able to quickly change the thickness of the water film on the surface of the roller 120. See FIG. 3 of the '546 patent incorporated above, and particularly the "isobar assembly 50" and associated description.

Figure 2A:
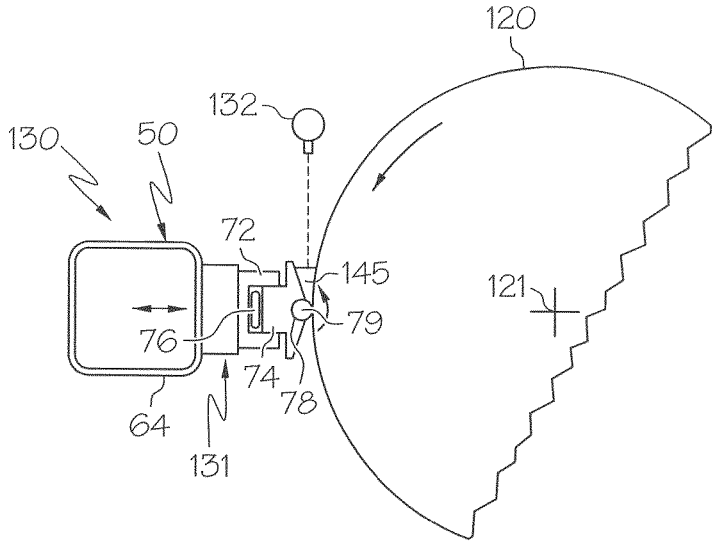
FIG. 2*a* is a close-up view of the thin film metering device in the medium conditioning apparatus of FIG. 2.

As best seen in FIG. 2*a*, the metering device 130 preferably includes a metering rod assembly 131 adapted to produce a precisely metered thin film of water onto the surface of the roller 120. The metering rod assembly 131 includes a channel member 72, a holder 74, a tubular pressure-tight bladder 76, and a metering rod 78. The channel member 72 is secured to the side of a frame member 64 and forms a longitudinally extending channel. The holder 74 has a projection on an inner side and a groove on an outer side. The projection is sized and shaped to extend into the channel so that the holder 74 is moveable toward and away from the frame member 64 within the channel member 72. The groove is sized and shaped for receiving the metering rod 78 so that the metering rod 78 is mounted in and supported by the holder 74.

The bladder 76 is positioned between the holder 74 and the channel member 72 within the channel of the member 72. Fluid pressure, preferably air pressure, is applied to the bladder 76 of the metering rod assembly. The fluid pressure within the bladder 76 produces a force urging the holder 74 and the associated metering rod 78 toward the outer circumferential surface of the moisture application roller 120. The force produced by the bladder 76 is uniform along the entire length of the metering rod 78.

The metering rod 78 is supported such that the metering rod 78 is not deflected up or down with respect to the roller 120 as a result of the hydraulic pressure, i.e. the metering rod 78 is urged toward the roller 120 such that the metering rod axis 79 and the applicator axis 121 of the moisture application roller 120 remain substantially parallel and in the same plane during operation. Therefore, the metering rod 78 is positioned to produce a uniform thickness or coating of water on the outer circumferential surface of the moisture application roller 120 along its entire length.

Figure 2B:
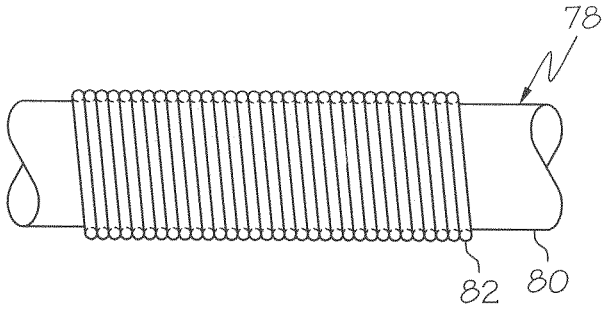
FIGS. 2*b*-2*d* illustrate various features and/or alternatives of metering rods useful in the thin film metering device.
Figure 2C:
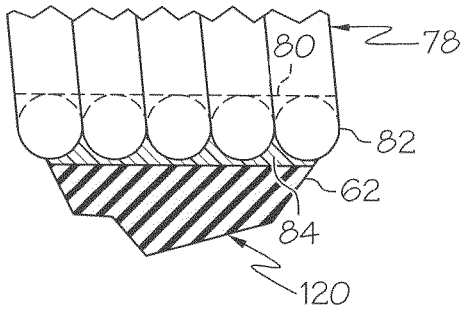

As best shown in FIGS. 2*b* and 2*c*, the metering rod 78 preferably includes a cylindrical rod 80 and spiral wound wire 82 thereon. The rod 80 extends the length of the moisture application roller 120 and has a uniform diameter such as, for example about ⅝ of an inch. The wire 82 has a relatively small diameter such as, for example, of about 0.06 inches. The wire 82 is tightly spiral wound around the rod 80 in abutting contact along the length of the rod 80 to provide an outer surface, best illustrated in FIG. 2*c*, that forms small concave cavities 84 between adjacent windings of the wire 82. When a spiral-wound wire 82 is used to provide the cavities 84, those cavities take the form of a continuous groove that extends helically around the rod 80.

As best shown in FIG. 2*a*, the metering rod 78 is mounted in and supported by the outer groove of holder 74 for rotation therein about its central axis 79. The metering rod 78 is operatively coupled to and rotated by a motor 75, illustrated schematically in FIG. 2. In operation, the metering rod 78 is rotated at a relatively high speed in the same angular direction as the rotation of the moisture application roller 120 (counterclockwise in FIG. 2*c*).

Figure 2D:
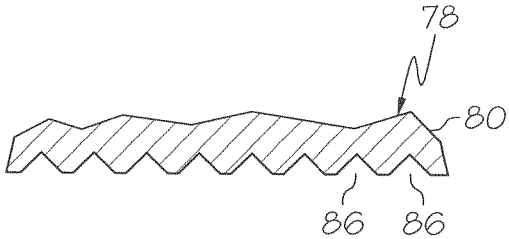

As best shown in FIG. 2*d*, the metering rod 78 can alternatively be a solid rod that has been machined to provide a grooved outer surface rather than having wire wound thereon. The machined outer surface preferably has inwardly extending cavities or grooves 86 that function similarly to the concave cavities 84 formed by the wire 82. The illustrated grooves 86 are axially spaced along the length of the metering rod 78 to provide narrow flat sections between the grooves 86. This embodiment of the metering rod 78 tends to remove a greater amount of film material and is typically used in applications where very thin coatings of adhesive are required (as in the single-facer 300 and the glue machine 400 described below). Additional details regarding the preferred thin film metering device can be found through reference to the aforementioned U.S. patents.

Returning to FIGS. 2 and 2*a*, in operation the moisture application roller 120 is rotated such that at the point where it contacts the web of medium material 10 its surface is traveling in an opposite direction relative to the direction of travel of that web 10. This, coupled with the tension in the web, aids in driving moisture from the roller 120 into the passing medium material web 10 to provide substantially uniform moisture penetration. Water is fed from a reservoir (not shown) into a pond 145 via a spray bar 132 located above the metering rod 78 (most clearly seen in FIG. 2*a*). The pond 145 is preferably created by loading the metering rod 78 uniformly against the circumferential surface of roller 120 using a flexible rod holder 74 that pushes the metering rod 78 against the roller 120, and filling the resultingly defined cavity with water from the spray bar 132. The metering rod 78 acts as a dam to prevent the water in the pond 145 from escaping uncontrollably around the surface of the moisture application roller 120. End dams (not shown) also are provided and prevent the water from escaping around the edges of the metering rod 78 and roller 120. The grooves 84/86 in the rod 78 volumetrically meter the amount of water deposited onto the circumferential surface of the roller 120 as that surface rotates past the metering rod 78 by restricting the amount of water than can pass through the grooves from the pool 145. This effect results in a very thin film of moisture on the surface of the roller 120 with negligible cross roller variation.

By appropriate regulation of 1) the tension of the medium material web past the moisture application roller 120, 2) the rotational speed of that roller 120, and 3) the thickness of the moisture film provided on the surface of that roller 120 using the metering device 130, very precise quantities of moisture can be added to the medium material 10 in order to raise or adjust its moisture content within the desired range, most preferably about 7-9 wt. % or 7-8 wt. %. A moisture sensor (not shown) can be mounted downstream of the moisture application roller 120 and used in a feedback control loop as known in the art to maintain a downstream moisture set point. Alternatively, such a sensor also could be mounted upstream in a feedforward control loop so the system can anticipate changes in incoming medium material 10 moisture. In response to signals from these sensor(s), a control system can adjust the speed of the moisture application roller 120 or the web tension to adjust the amount of moisture transferred from the roller 120 to the passing web of medium material 10.

Optionally, the medium conditioning apparatus 100 can be provided without (i.e. excluding) the pretensioning mechanism 110, particularly if the web tension upstream (supplied by the source of medium material) is also suitable for operation of the moisture application roller 120 to impart adequate moisture to the web 10. It is believed this will be the case in many if not most practical applications, so the pretensioning mechanism 110 should be considered an optional component and may be omitted.

Figure 3:
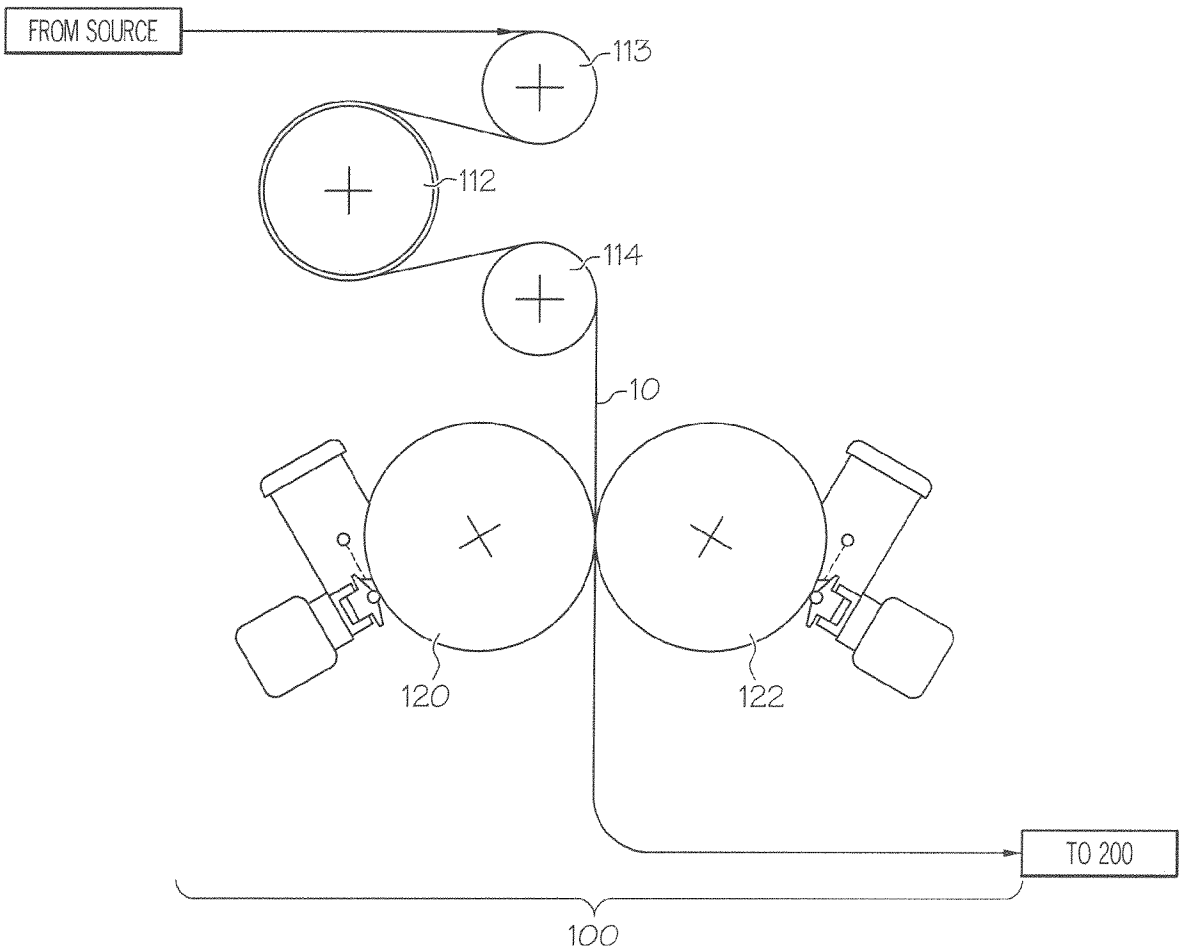
FIG. 3 is a schematic diagram of an alternative structure for a medium conditioning apparatus, having two moisture application rollers, one for applying moisture from each side of the web of medium material.

In the embodiment illustrated in FIG. 2, moisture is applied to the web 10 from only one side, namely the side adjacent the moisture application roller 120. It is believed, however, it may be advantageous to apply moisture either simultaneously or successively from both sides of the web 10 in order to ensure more uniform moisture penetration. Application of moisture from both sides also should ensure the same moisture content at both the outer surfaces of the web 10 so that one side is not substantially more or less moist than the other. Differences in relative moisture content at the two outer surfaces of the web 10 can lead to warpage or washboarding because the two sides will have dissimilar flexibility. FIG. 3 shows an alternative structure for a medium conditioning apparatus, wherein two moisture application rollers 120 and 122 are used to apply moisture from opposite sides of the web 10. In the illustrated embodiment, the two moisture application rollers 120 and 122 are shown directly opposite one another, to apply moisture to the web 10 at the same location along the web pathway. However, the two moisture application rollers 120 and 122 could less preferably be located at successive positions along the web pathway. In the latter case, it is preferred the web pathway for the web 10 as it traverses the two moisture application rollers 120 and 122 is somewhat serpentine, i.e. so the web 10 follows a somewhat serpentine or "S"-shaped path as it traverses the rollers 120 and 122. This way, the web 10 is drawn somewhat against both rollers, adjacent each of its outer surfaces, to ensure moisture penetration from each side.

Figure 4:
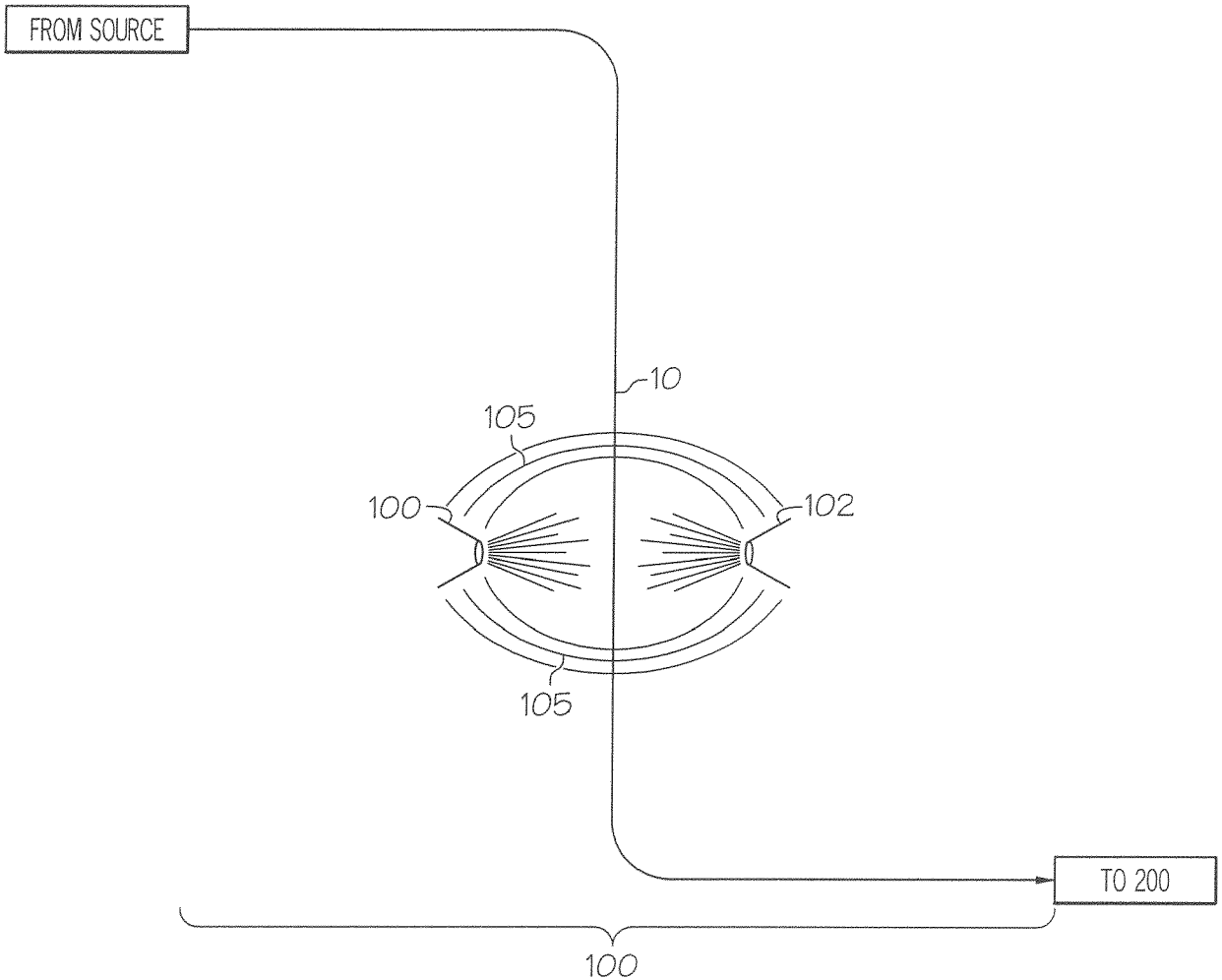
FIG. 4 is a schematic diagram of a further alternative structure for a medium conditioning apparatus, wherein moisture is applied from both sides of the web of medium material using an electrostatic water-spray apparatus.

FIG. 4 illustrates a further preferred embodiment for the moisture conditioning apparatus 100. In this embodiment, moisture is imparted into the web 10 from a pair of water spray nozzle assemblies 160 and 162 located on either side of the web pathway for the web 10 as it travels through the apparatus. Preferably, the web 10 travels between the nozzle assemblies 160 and 162 in a vertical path and the nozzles are located on opposite sides at substantially the same elevation as shown. The nozzle assemblies are operable to spray a fine or atomized water mist at the respective adjacent outer surfaces of the web 10. It is also desired to apply an electrostatic field, illustrated schematically at 165, that is effective to drive or accelerate the water mist or droplets into the web 10. Otherwise, without the electrostatic field, water still will fall upon the outer surfaces of the web 10, and it will diffuse therein, but much water will be wasted, forming a cloud of moisture on both sides of the web. As a result of these clouds of unabsorbed moisture, it will be difficult to tell with certainty exactly how much of the water being sprayed ends up in the web 10. Also, water mist from one side may penetrate more effectively than the other at any given moment, and the depth of penetration may vary from moment-to-moment, side-to-side. The result would be relatively unpredictable, or at least non-uniform, moisture application into the web 10. But with the electrostatic field that is effective to accelerate moisture into the web, much more precise and predictable moisture application into the web 10 can be achieved. Thus, it will be understood regulating flowrate of water emitted from the nozzle assemblies 160 and 162, the fine-ness of the mist, the parameters of the electrostatic field and the lineal speed of the traveling web 10.

Precise details and structure of the nozzle assemblies 160 and 162 as well as of the means for generating the appropriate electrostatic field are not critical to the present invention, and are available elsewhere as known to persons of ordinary skill in the art. For example, a suitable electrostatically regulated water-spray system for moisture application as described herein is available from Eltex-Elektrostatik-GmbH, Weil am Rhein, Germany, under the tradename "Webmoister" for example the Webmoister 60 and Webmoister 70XR products of this product line from Eltex.

In this embodiment, the pretensioning mechanism 110 is preferably omitted because unlike a moisture application roller 112 where tension (force) of the web against the roller may be a significant factor contributing to moisture application, here this is less so. Moisture is applied without contacting to moisture application, is not drawn against any structure that is responsible for imparting or driving moisture into the web.

Pre-Corrugating Web Tensioner

Figure 5:
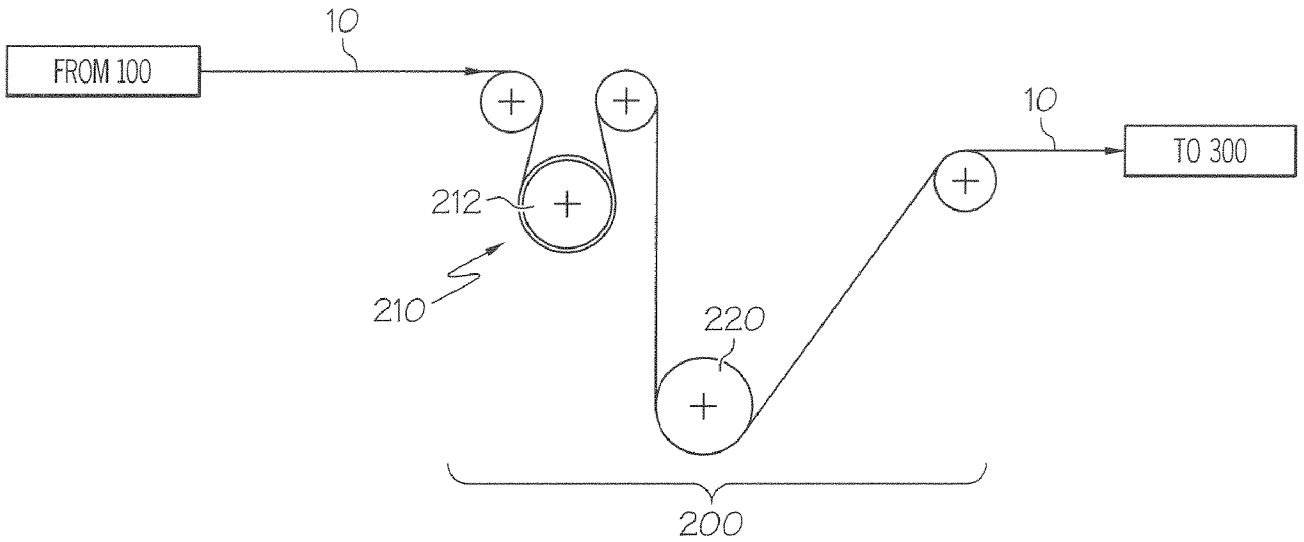
FIG. 5 is a schematic diagram of a pre-corrugating web tensioner that can be used in a cold corrugating method.

On exiting the medium conditioning apparatus 100, the conditioned (e.g. moisture content preferably adjusting to about 7-9 wt. %) web of medium material 10 proceeds along a web path to and through a pre-corrugating web tensioner 200 as illustrated schematically in FIG. 5. In the illustrated embodiment, the web tensioner 200 includes a corrugating pretensioning mechanism 210 and a stationary zero-contact roll 220. The pretensioning mechanism 210 is provided and functions in a similar manner as the pretensioning mechanism 110 described above. The corrugating pretensioning mechanism 210 preferably is provided downstream of the medium conditioning apparatus 100 and upstream of the single-facer 300 in order that web tension in the medium material 10 can be independently selected based on separate and distinct web tension requirements in the medium conditioning apparatus 100 and in the single-facer 300. By including separate pretensioning mechanisms 110 and 210, the web tension for the medium material 10 can be set independently in the medium conditioning apparatus 100 and on entering the single-facer 300 without regard to the tension requirements for the other stage in the process.

Alternatively, when the pretensioning mechanism 110 is not used, the corrugating pretensioning mechanism 210 still provides independent mean tension control of the web 10 on entering the single-facer 300 (and particularly the corrugating labyrinth 305), independent of the tension in that web 10 upstream. Note that the speed of the web 10 through the corrugating apparatus 1000 is controlled primarily by the demand for medium material through the corrugating labyrinth 305 based on the speed of the corrugating rollerers 310 and 311 (described below), which are located downstream. Similarly as described above, the suction roller 212 for the corrugating pretensioning mechanism 210 is rotated in the same direction as the web 10 is traveling around its outer circumferential surface, but with that surface traveling at a slower linear speed than the web in order to provide the desired tension downstream. Ideally, the surface linear speed of the suction roller 212 would be exactly the same as the speed the web 10 is traveling, resulting in a mean tension in that web of zero on entrance into the corrugating labyrinth 305. In practice, however, this is difficult to achieve without causing slacking of the web 10 on entering the corrugating labyrinth 305. So some fininte, non-zero tension typically is desirable in the web on entrance into the corrugating labyrinth 305, which requires the surface linear speed of the suction roller 212 to be modestly slower than the speed of the web 10. But as explained in the next paragraph, much lower mean tension values can be achieved using the corrugating pretensioning mechanism 210, such as 1-2 pli or less, compared to the conventional pinch-roller or nip-roller method of pretensioning prior to corrugating. Precise downstream tension control also can be selected by adjusting the radial velocity (and correspondingly the surface linear velocity) of the suction roller 212.

Conventionally, tension in the web 10 on entering the single-facer 300, more particularly the corrugating nip 302 between the corrugating rollers 310 and 311, is adjusted using pretensioning nip rollers (pinch rollers) that are rotated at a circumferential lineal speed that is less than the speed of the web. The web passes through the nip rollers and is compressed therebetween, thereby imparting the desired downstream tension. However, this conventional mode of pretensioning suffers from numerous drawbacks, in particular: 1) very accurate tension control is not possible, and typically the downstream tension is maintained in the range of 2-3 fpi, and 2) the nip rollers necessarily must compress/crush the medium material 10 between them to generate sufficient normal force to effect frictional engagement with the traveling web of material. The disclosed suction roller 212 is far superior in that it does not require crushing the medium material 10 to ensure suitable frictional engagement and consequent downstream tension control (it operates by sucking the medium to its surface). Also, it provides far more precise downstream tension control than is possible using nip rollers. Using the suction roller 212, it is possible to adjust the downstream tension lower than the 2-3 pli conventionally achieved, for example as low as nominally zero or near zero by adjusting the surface linear speed thereof to approach the linear speed of the web. In practice this may be somewhat impractical for reasons explained above. But using the suction roller 212, downstream tension in the web 10 on entry into the corrugating nip 302 preferably less than 2, preferably less than 1, pli are achieved.

It is desirable that the web of medium material 10 enter the corrugating labyrinth 305 defined at the nip 302 having as low a mean web tension as possible (practical). This is because the mean tension in the web 10 is compounded significantly as a result of traversing the labyrinth 305. Specifically, tension of the web through the labyrinth 305 is governed by the brake band equation:

$$T=T_o e^{\mu\phi}$$

where:

T≡tension in the web on exiting the corrugating labyrinth 305, $T_o$≡the initial tension in the web on entering the labyrinth 305, e≡is the base of the natural logarithm, μ≡the coefficient of friction medium-to-corrugating roller, and ϕ≡the total wrap angle (in radians) the web 10 travels around and in contact with the corrugating teeth through the corrugating labyrinth 305.

From the foregoing equation, it is evident that mean web tension in the labyrinth 305 increases as an exponential function of the initial tension in the web 10. Therefore, in addition to damping or nulling oscillatory tension effects using the zero-contact roll 220, it is desirable to ensure initial web tension, $T_o$, is as low as possible so that tension on exiting the labyrinth 305, T, is as low as possible. This is achieved through precise web tension metering using the corrugating pretensioning apparatus 210 in the manner described above.

Also, when the first pretensioning mechanism 110 is used the web of medium material 10 is stretched between the first and second pretensioning mechanisms 110 and 210 so that wrinkles are pulled out and the web has enough dwell time following the moisture application roller 120 to absorb substantially all the moisture applied. This produces a more pliant web that is more amenable to being cold formed to produce the corrugations or 'flutes' between the corrugating rollers 310 and 311 (described below). Similarly as for the first pretensioning mechanism 110 above, one or a set of load cells (not shown) also can be provided downstream of the second suction roller 212 for tension feedback control.

Figure 6:
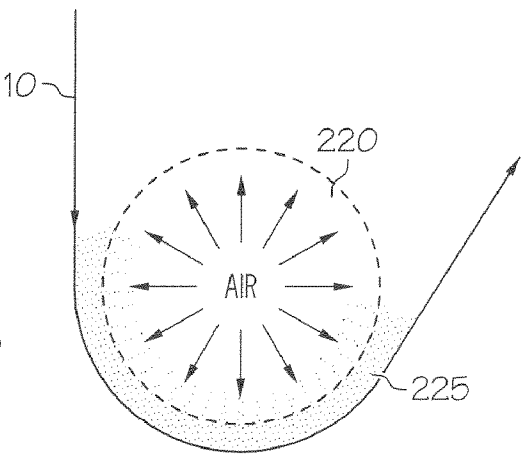
FIG. 6 is a close-up schematic diagram of a "mass-less dancer" for imparting high-frequency nulling or damping of tension fluctuations in the corrugating medium (web of medium material) that result as the medium is drawn through the corrugating labyrinth as further described hereinbelow.

The zero-contact roll 220 is a stationary roll, and does not rotate as the web of medium material traverses its circumferential surface. Instead, a volumetric flowrate of air at a controlled pressure is pumped from within the roll 220 radially outward through small openings or holes 221 provided periodically and uniformly over and through the outer circumferential wall of the roll 220 (see FIGS. 6-6*a*). The result is that the passing web of medium material 10 is supported above the circumferential surface of the zero-contact roll 200 by a cushion 225 of air. The necessary pressure of air to support the passing web of medium material 10 above the zero-contact roll surface is governed by the equation:

$$P=T/R$$

where P is the required air pressure (in psi), T is the tension (mean tension) in the traveling medium material web (in pounds per lineal inch or 'pli'), and R is the radius of the zero-contact roll 220 (in inches). The nominal height above the circumferential surface of the roll 220 for the traveling web 10 is proportional to the volumetric flowrate of the air that is flowing through the openings in the circumferential surface. In a desirable mode of operation, the air volumetric flowrate is selected to achieve a nominal height for the web 10 (also corresponding to the height of the air cushion 225) of, e.g., 0.2-0.5 inch above the circumferential surface of the roll 220 depending on its radius, which is typically 4-6 inches. Alternatively, the flowrate can be selected to achieve a lower nominal height, for example 0.025-0.1 inches off the circumferential surface of the roll 220. The principal tension variance nulling function and effect of the zero-contact roll 220 as just described will be more fully understood and explained in the context of the following discussion of the single-facer 300, and more particularly of the corrugating rollers 310 and 311.

Figure 6A:
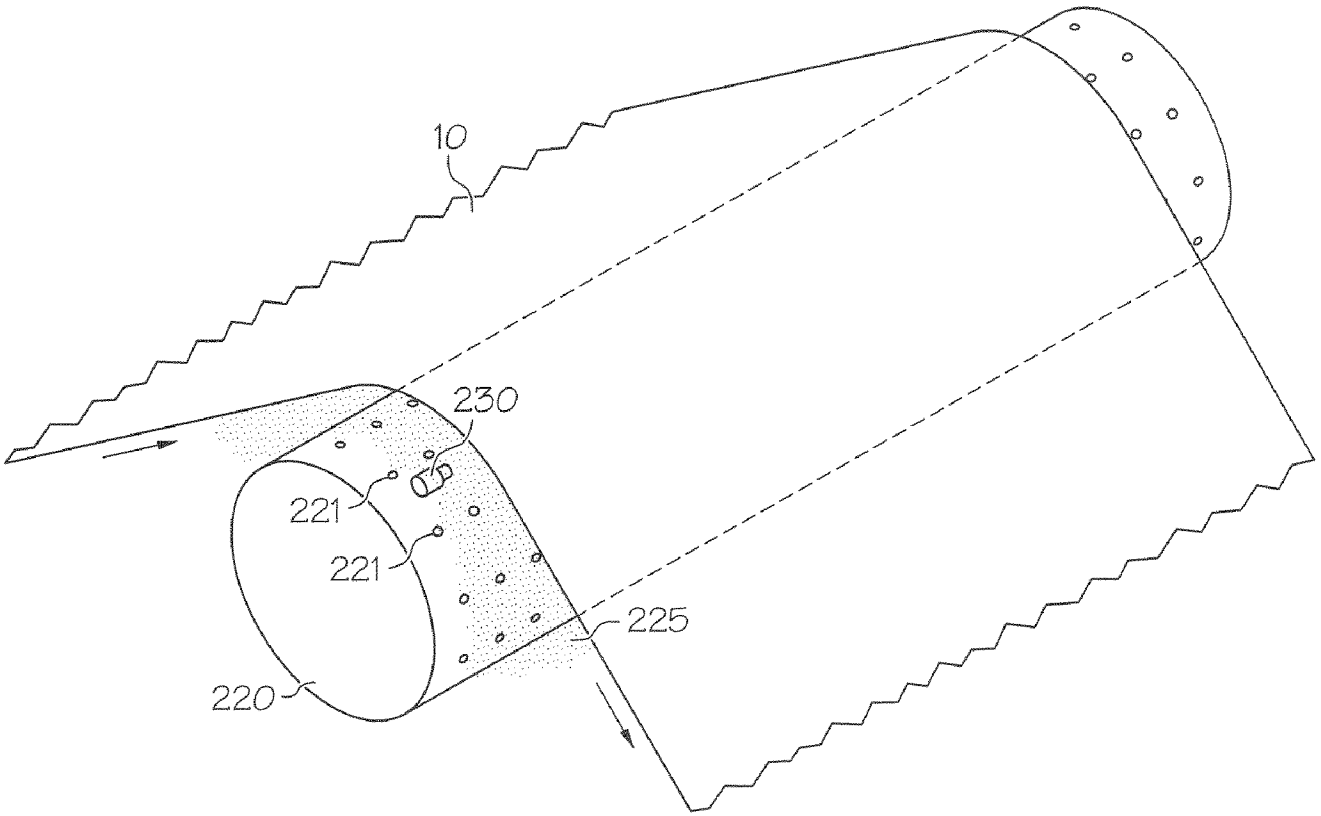
FIG. 6*a* is a perspective schematic view of the "mass-less dancer" of FIG. 6 shown at a point during operation as the web of medium material travels above its surface supported on a cushion of air.

Meantime, the zero-contact roll 220 also provides an elegant mechanism for providing feedback control for the mean web tension. Referring to FIG. 6*a*, a passive pressure transducer 230 can be used to detect the pressure in the air cushion 225 that is supporting the web 10 over the surface of the zero-contact roll 220. Because air cushion pressure and web tension are related according to the relation P=T/R as noted above, monitoring the air cushion pressure, P, provides a real-time measure of the tension in the web 10. For example, if the radius of the roll 220 is fixed at 6 inches, and the air cushion pressure is measured at 0.66 psi, then one knows the tension in the web at that moment is 4 pli. As will be apparent, the real-time web tension data that can be inferred from measuring the pressure of the air cushion 225 can be used in a feedback control loop to regulate the operation of either or both of the suction rollers 112 and/or 212. When only a single suction roller is used, such as suction roller 212, then the feedback tension data supplied by the measurements of transducer 230 can be used to regulate the operation of that suction roller to ensure a desired set-point tension in the web 10.

Herein, "zero-contact roll" refers to a roll having the above structure, adapted to support a web of material passing over the roll on a cushion 225 of fluid, such as air, that is emitted through holes or openings provided over and through the outer circumferential surface of the roll. It is not meant to imply there can never be any contact (i.e. literally "zero" contact) between the zero-contact roll and the web. Such contact may occur, for example, due to transient or momentary fluctuations in mean web tension.

Single-Facer

Figure 7:
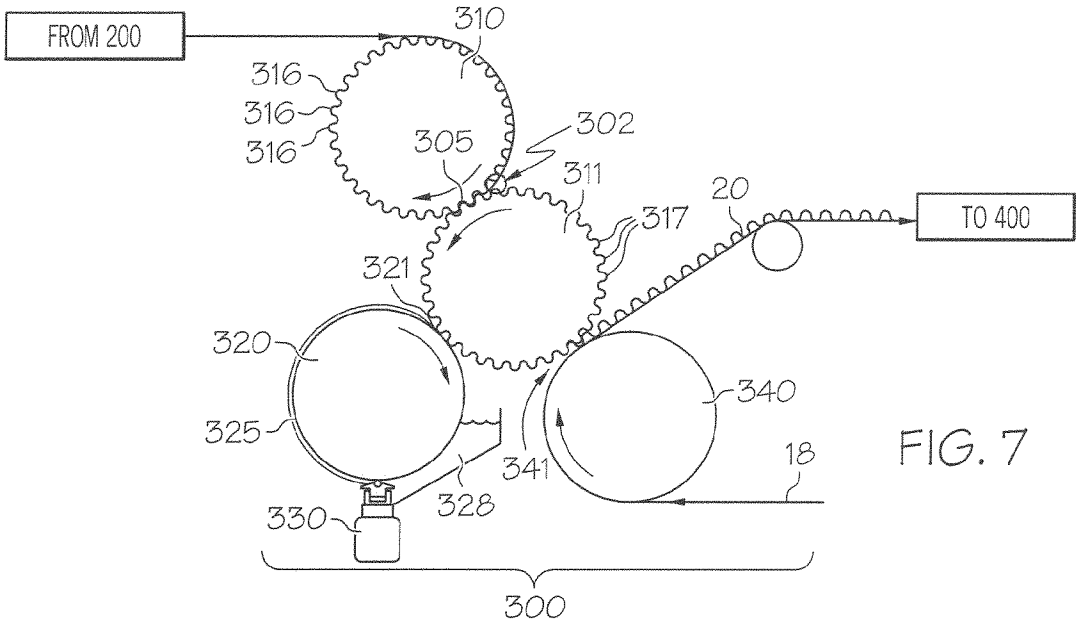
FIG. 7 is a schematic diagram of a corrugator/single-facer (referred to hereinafter as a "single-facer") that can be used in a cold corrugating method.

On exiting the web tensioner 200, the now conditioned and pretensioned web of medium material 10 enters the single-facer 300 along a path toward a nip 302 defined between a pair of cooperating corrugating rollers 310 and 311. The first corrugating roller 310 is mounted adjacent and cooperates with the second corrugating roller 311. Both the rolls 310 and 311 are journaled for rotation on respective parallel axes, and together they define a substantially serpentine or sinusoidal pathway or corrugating labyrinth 305 at the nip 302 between them. The corrugating labyrinth 305 is produced by a first set of radially extending corrugating teeth 316 disposed circumferentially about the first corrugating roller 310 being received within the valleys defined between a second set of radially extending corrugating teeth 317 disposed circumferentially about the second corrugating roller 311, and vice versa. Both sets of radially extending teeth 316 and 317 are provided so that individual teeth span the full width of the respective rolls 310 and 311, or at least the width of the web 10 that traverses the corrugating labyrinth 305 therebetween, so that full-width corrugations can be produced in that web 10 as the teeth 316 and 317 interlock with one another at the nip 302 as the rolls rotate. The corrugating rollers 310 and 311 are rotated in opposite angular directions as illustrated in FIG. 7 such that the web of medium material 10 is drawn through the nip 302, and is forced to negotiate the corrugating labyrinth 305 defined between the opposing and interlocking sets of corrugating teeth 316 and 317. On exiting the nip 302 (and corrugating labyrinth 305), as will be understood by those of ordinary skill in the art the medium material 10 has a corrugated form; i.e. a substantially serpentine longitudinal cross-section having opposing flute peaks and valleys on opposite sides or faces of the medium material 10.

Figure 7A:
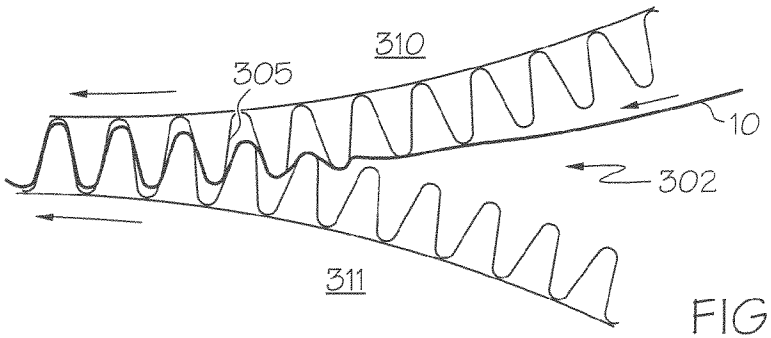
FIG. 7*a* is a close-up view of the corrugating labyrinth 305 at the nip 302 between opposing first and second corrugating rollers 310 and 311 illustrated in FIG. 7.
Figure 8:
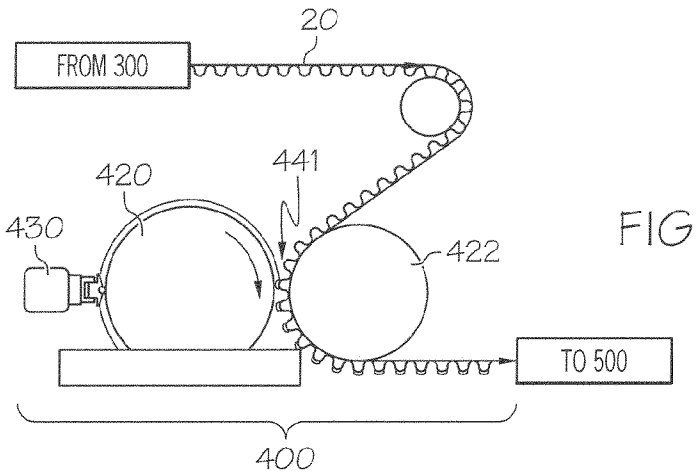
FIG. 8 is a schematic diagram of a glue machine that can be used in a cold corrugating method.

With the foregoing in mind, the effect and significance of the zero-contact roll 220 in the web tensioner 200 will now be explained. Referring to FIG. 7*a*, a close-up of the nip 302 between the corrugating rollers 310, 311 is shown at a moment during operation, as the web of medium material 10 is drawn therein and is forced to negotiate the corrugating labyrinth 305, which imparts to the medium material its corrugated (fluted) form. First it will be evident that the lineal take-up speed of the web 10 (on approach of the corrugating nip 302) is faster than the lineal discharge speed of the corrugated web on exiting the nip 302 because a substantial portion of the web length is taken up or consumed by fluting. Typically, for conventional size flutes the take-up speed may be in the range of 1.2-1.55 times the discharge speed, although larger or smaller ratios are possible. Second, it also will be evident from FIG. 7*a* that the tension of the web of medium material 10, as well as transverse compressive stresses, oscillate in magnitude as successive flutes are formed in the web 10 due to the relative up-and-down motion of the corrugating teeth, and due to roll and draw variations in the web 10 through the labyrinth 305 as it is being corrugated.

The oscillatory nature of the web tension through the corrugating labyrinth 305 between corrugating rollers is well documented; see, e.g., Clyde H. Sprague, *Development of a Cold Corrugating Process Final Report*, The Institute of Paper Chemistry, Appleton, Wash., Section 2, p. 45, 1985. The fundamental frequency of the oscillating forces is the corrugation or 'flute' forming frequency, but large higher harmonics are usually present. The variations in web tension are particularly important because they will be magnified in the labyrinth. Substantial cyclic peaks in web tension may occur as a result. Whether formed hot or cold via conventional processes, the web of medium material 10 typically sustains some structural damage. Visible damage is referred to as flute fracture, and this type of damage generally results in a useless product. The conditions at the onset of fracturing are often used as indicators of runnability.

Web stiffness or resistance to bending also will contribute to tension build-up and may be a factor in the fracture of heavyweight or very dry mediums. For lightweight or moist mediums, however, friction-induced tension is believed to dominate the fracture picture. One way to minimize tension build-up, and hence the propensity for fracture, would be to regulate the initial tension of the web such that it is appropriately raised and lowered by corresponding magnitudes in phase with tension oscillations that result from the web 10 traversing the labyrinth 305, in order to compensate for such oscillatory tension variance. Up till now, such damping at the magnitudes and frequencies required has not been possible with conventional machinery (see below). Other variables that can be adjusted to compensate for tension oscillations are the coefficient of friction between the medium material 10 and the corrugating rollerers 310, 311, the contact angle of the web with the rollers, and the initial mean web tension on entry into the corrugating nip 302. In a preferred embodiment, all three of these variables are suitably adjusted/varied. Coefficient of friction is lowered by conditioning the web in the medium conditioning apparatus 100 as described previously. The contact angle can be lowered by selecting and using corrugating rollers 310, 311 having the smallest practicable radius for the desired flute size. Lastly, by using the corrugating pretensioning mechanism 210 to very accurately meter the web tension prior to entry into the single-facer, initial mean web tension can be adjusted to a precise value in a very low range; i.e. within the range of 0-3 pli, preferably less than 2 or 1 pli, compared to conventional initial web tension which typically is less precisely controlled and in the range of 2-3 pli.

In addition, the zero-contact roll 220 provides an additional mode that is effective to provide tension variance damping. This is a significant additional mechanism to counterbalance or dampen oscillatory tension variances resulting from the web being drawn through the corrugating labyrinth 305, which was not possible using existing machinery. As more fully described below, the zero-contact roll 220 provides accurate and proportionate web tension compensation for oscillatory variances in web tension as a result of the medium material 10 web traversing the corrugating labyrinth 305, at the frequencies and magnitudes of such tension variances.

The difficulty in designing a suitable web tension compensator mechanism for these oscillatory web tension variances is that the basic frequency of the oscillations is extremely large, based on the rate of forming flutes (for a 1400 fpm line, as high as 2,800 cycles per second or "Hertz" assuming 10 flutes per inch). Also, the actual frequency may be higher and largely unpredictable as a result of higher order harmonics. Another problem is that the magnitude of the tension oscillations, though enough to potentially fracture the medium material, still is very small, making its quantification very difficult at high frequency, and making impossible the design of an active control system that can physically respond to such oscillations at the necessary frequency. Also, bending-induced fractures occur because of excessive tensile strain in the outer fibers at the tips of forming flutes. In the absence of a shear strain, the outer surface of the medium would have to extend by about 7% to accommodate the flute shape; medium failure occurs at only 3% elongation.

While these problems associated with web tension oscillations are present in conventional hot-forming methods and machinery, their effect is largely counteracted by heating the corrugating rollers, which lowers the coefficient of friction sufficiently to minimize web fracture. However, for a successful cold-forming method and apparatus, the corrugating rollers are not heated and these problems must be addressed head-on.

By threading the web path over a zero-contact roll 220 at a location upstream of the corrugating rollers 310, 311, such that the web is supported above the surface of the zero-contact roll 220 on a cushion 225 of air, the traveling medium material web 10 is able to respond instantaneously to high-frequency, low-magnitude tension variances downstream by simply "dancing" above the surface of the zero-contact roll 220. Conventional dancing rollers or "dancers" as they are sometimes called are well known in the art. These are rotating rollers mounted on journals that are suspended at both ends on translatable members, such as chucks that can slide along a track in response to changing downstream tension requirements. However, a conventional dancing roller cannot be used in the present application because its mass would make it impossible to adjust at the necessary frequency, i.e. on the order of several thousand times per second; not to mention the infinitesimally small displacements that would be required to compensate, at such frequencies, to oscillatory tension variances as the web 10 is drawn through the corrugating labyrinth 305.

By utilizing a zero-contact roll 220 as previously described, the inventor herein has provided an essentially "mass-less" dancer that can passively respond to very minute and high frequency variances in downstream tension demand The "mass-less" dancer achieves this objective in the following manner. As the downstream tension demand increases, the web traveling above the surface of the zero-contact roll 220 simply is drawn closer to that surface as a result of the increased downstream tension. The result is that the instantaneous linear speed of the medium material 10 web on approach of the nip 302 is increased for the moment when the tension demand is increased, thus effectively nulling the increased tension demand. Likewise, when the downstream tension demand is decreased, the force (tension) drawing the web traveling above the surface of the zero-contact roll 220 toward that surface is decreased, and thus the web height above that surface correspondingly increases. The result here is that the instantaneous linear speed of the medium material 10 web on approach of the nip 302 is decreased for the moment when the tension demand is decreased, again effectively nulling the decreased tension demand.

While the traveling web does have mass, and therefore inertia, the magnitude of that mass for the length of the web in question (i.e. that portion over the zero-contact roll 220, which must oscillate up and down) is very near zero. As a result, while the "mass-less" dancer will not provide mathematically perfect tension variance damping because the inertia of the web traveling over the zero-contact roll 220 is not mathematically zero, it will substantially dampen such tension variance oscillations, and at the magnitudes and frequencies required.

The "mass-less" dancer is a passive damping system that can respond in real time and at the very high frequencies demanded of modern corrugating equipment. This is due to the near-zero mass of the only moving part in the system; namely, the web itself in the length segment passing over the zero-contact roll 220. The "mass-less" dancer disclosed herein provides an elegant solution to a long-standing problem, and enables the production of corrugated medium with little or no fracturing of the web using low- or room-temperature corrugating rollers 310, 311. It will be evident that sufficient tension must remain in the web to ensure adequate web tracking through the single-facer 300. However, because the "mass-less" dancer is a passive tension variance damping system that only responds to minute downstream changes in tension demand, the basic or mean tension of the web through the single-facer 300 can still be separately precisely controlled, e.g. using the pretensioning mechanism 210 of the web tensioner 200, and is not affected by the "mass-less" dancer system.

Returning now to FIG. 7, after emerging from the corrugating labyrinth 305, the now-corrugated medium material 10 is carried by the second corrugating roller 311 through a glue nip 321 defined between that corrugating roller 311 and a first glue applicator roller 320. A thin film of glue 325 is applied to the surface of the applicator roller 320 from a glue reservoir 328 using a second thin film metering device 330. The second thin film metering device 330 is or can be of similar construction as the first thin film metering device 130 described above, except that minor modifications may be desirable as the present device applies glue, such as a high-solids or high-starch glue having a water content of only, e.g., 50-60 wt. % water, whereas the previous device applied a thin film of water. For the second metering device 330 discussed here, the small concave cavities 84 of the metering rod 78 (see FIGS. 2*b*-2*d*) provide spaces with respect to the smooth outer surface of the first glue applicator roller 320 so that small circumferentially extending ridges of adhesive remain on the surface of the applicator roller 320 as that surface rotates past the metering rod 78.

It should be noted that even though adhesive on the outer surface of the applicator roller 320 tends to be initially applied in the form of ridges, the adhesive tends to flow laterally and assume a uniform, flat and thin coating layer via cohesion. Of course, the viscosity of the adhesive in relation to the cohesion thereof determines the extent to which the adhesive coating becomes completely smooth. Preferably, the adhesive is a high-solids content adhesive (described in more detail below), having a viscosity of 15-55 Stein-Hall seconds.

The position of the metering device 330 is adjustable toward and away from the applicator roller 320 to precisely set the gap therebetween. When the metering device 330 is adjusted so that metering rod 78 is in virtual contact with the outer circumferential surface of the applicator roller 320, essentially all of the adhesive except that passing through the concave cavities between adjacent turnings of the wire 82 or grooves 86 in the rod 78 (see FIGS. 2*c*-2*d*) is removed from the outer circumferential surface of the applicator roller 320.

On the other hand, when the metering rod 78 is spaced slightly away from the outer circumferential surface of the applicator roller 320, a coating of adhesive having greater thickness remains on the outer circumferential surface of the applicator roller 320. In a preferred embodiment the metering device 330 is positioned with respect to the applicator roller 320 to provide a uniform adhesive coating on the outer circumferential surface having the preferred thickness for the desired flute size as explained, e.g., in the '546 patent incorporated hereinabove. It will be understood that the optimal position for the metering device 330 will depend on the viscosity, the solids content, and the surface tension of the adhesive being used, as well as the size of the flutes (e.g. A, B, C, E, etc.). In conjunction with the metering device 330, it is possible to use a glue with very high solids content, preferably at least 25, more preferably 30, more preferably 35, more preferably 40, more preferably 45, more preferably 50 weight percent solids, or greater, balance water, compared to other conventional glue film application systems.

After the corrugated medium material 10 emerges from the glue nip 321, it continues around the second corrugating roller 311 on which it is supported to and through a single-face nip 341 where a first face-sheet web 18 is contacted and pressed against the glue-applied exposed flute crests of the medium material 10. A single-face roller 340 presses the first face-sheet web 18 against the flute crests to produce a single-faced web 20 on exiting the single-facer 300.

In a cold corrugating apparatus and associated method, the medium material 10 is formed (fluted) and the final product assembled without using heat to drive off excess water from the applied adhesive, which adheres both the first and second face-sheet webs 18 and 19 to the corrugated material medium 10. Thus, the adhesive used both in the single-facer 300 to adhere the first face-sheet web 18 and in the glue machine 400 to adhere the second face-sheet web 19 (discussed below) must have a higher solids and lower water content compared to traditional starch adhesives, which have anywhere from 75 to 90 wt. % water content. A preferred adhesive for use in the present invention exhibits several characteristics not common to adhesives used in conventional corrugators that use steam heat to drive of excess moisture. The apparatus can exclude a device applying heat to the web of medium 10 material between the zero-contact roll 220 and the corrugating labyrinth 305. In one example, utilizing an adhesive as described above, the corrugated material medium 10 can proceed over said zero-contact roll 220 and through said corrugating labyrinth 305 under ambient temperature conditions without the application of heat.

The adhesive preferably includes in excess of 40% solids, and achieves a strong bond without requiring that its temperature be raised above a gel point threshold. Such a high-solids content adhesive begins to develop its bond quickly enough to hold the medium material 10 and the face-sheet web 18 or 19 together during the corrugation process so that the resulting laminate web can continue to be processed through the apparatus. The adhesive also provides a strong enough bond at low moisture levels so that no post application drying is required to reduce the moisture level of the combined board below a threshold required for proper board structural performance.

Figure 9:
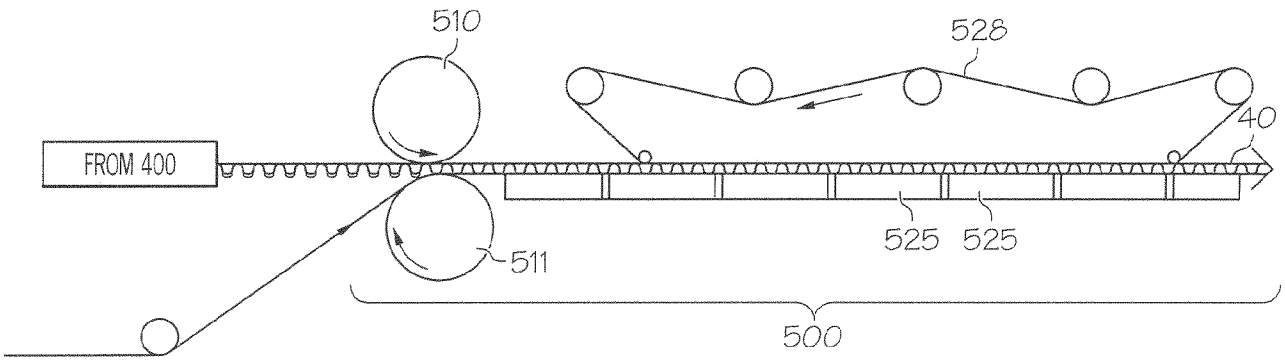
FIG. 9 is a schematic diagram of a double-backer that can be used in a cold corrugating method.

It is generally assumed that finished corrugated board 40 exiting the corrugating apparatus 1000 (see FIG. 9) must have a moisture content of between 6-8 wt. % for proper conversion into boxes. The following paper examples show the difference between applying a conventional starch adhesive and a thin film metered high-solids content adhesive as discussed herein on the moisture content as the board is combined. Both examples assume the moisture content of the face-sheet web and the medium material initially to be 6%.

Effect on Moisture Content for 35L-23M-35L

Conventional Adhesive
- STARCH DRY WEIGHT—2.5 lb/1000 SQUARE FEET
- SINGLEFACER & DOUBLEBACKER ADHESIVE SOLIDS—26% BONE DRY (APPROX. 29% AS MIXED)
- MOISTURE ENTERING DOUBLEBACKER 12.19%
- ASSUMES MEDIUM CONDITIONED TO 7%
- NO OTHER WATER SPRAYS High-Solids Content Adhesive
- ADHESIVE DRY WEIGHT—0.75 lb/1000 SQUARE FEET
- SINGLEFACER & DOUBLEBACKER ADHESIVE SOLIDS—50% BONE DRY
- MOISTURE ENTERING DOUBLEBACKER 7.25%
- ASSUMES MEDIUM CONDITIONED TO 8%

As can be seen, there would be a difference between the two applications (conventional versus high-solids content adhesive) of almost 5% moisture content entering the double-backer. With the cold corrugating example an even lower moisture content could be achieve by specifying the incoming face-sheet web moisture to be between 5 and 5-½% instead of the 6% assumed above. This would make final moisture of the combined board between 5.7 and 6.1%. Paper used to make corrugated board becomes very brittle below 4% moisture. This will not work for a hot process.

Glue Machine

The single-faced web 20 exits the single-facer 300 and enters the glue machine 400 where a similar high-solids glue as described above is applied to the remaining exposed flute crests in order that the second face-sheet web 19 can be applied and adhered thereto in the double-backer 500. In a preferred embodiment, the glue machine is provided as described in the '546 patent incorporated hereinabove, and applies a similar high-solids content glue (40-50 wt. % solids, or higher) as described above. Briefly, the glue machine 400 has a third thin film metering device 430 that is capable to accurately and precisely meter a thin film of the high-solids adhesive on the outer circumferential surface of the second glue applicator roller 420. The single-faced web 20 is carried around a rider roller 422 and through a glue machine nip 441 where glue is applied to the exposed flute crests of the passing single-faced web 20 as described in detail in the '546 patent, incorporated hereinabove.

Double-Backer

The single-faced web 20 having glue applied to the exposed flute crests enters the double-backer 500 through a pair of finishing nip rollers 510 and 511, where the second face-sheet web 19 is applied and adhered to the exposed flute crests and the resulting double-faced corrugated assembly is pressed together. Optionally, the double-backer 500 also may include, downstream from the finishing nip rollers 510 and 511, a series of stationary hot plates 525 defining a planar surface over which the finished corrugated board 40 travels. In this embodiment, a conveyor belt 528 is suspended over the hot plates and spaced a distance therefrom sufficient to accommodate the finished corrugated board 40 as it travels through the double-backer 500. The conveyor belt 528 frictionally engages the upwardly facing surface of the board 40, and conveys it through the double-backer 500 such that the downwardly facing surface is pressed or conveyed against the stationary hot plates 525.

It will be understood the hot plates 525 are optional components in the cold corrugating apparatus as disclosed herein, and may be omitted as unnecessary if an adhesive of suitably high solids content is used. It is anticipated that as conventional corrugators are converted to the cold process disclosed herein that other means of supporting the underside of the finished board 40 will replace the hot plates in the double-backer 500. For example, conveyor belts or air floatation tables could be used.

Corrugated board 40 made using the above-described equipment and the associated cold corrugating method will retain a greater proportion of its initial compressive strength because the corrugated medium material 10 is not substantially fractured or damaged. The avoidance of such fracture/damage in the web 10, despite being formed (fluted) at low temperature, is made possible through one or several of the improvement described herein. These improvements include: lowering the initial tension in the web as it is drawn into the corrugating labyrinth 305, adjusting the initial water content to about 7-9 wt. % or 7-8 wt. %, and providing the "mass-less" dancer to dampen high frequency downstream tension variances resulting from the web being drawn through the corrugating labyrinth 305. All of these mechanisms are implemented in a preferred embodiment as herein described. But fewer than all of them can be used in a particular corrugating apparatus; it is not necessary to implement and use all of the foregoing mechanisms. The use of high-solids content glue also as described permits operation of the entire system at low temperature because far less excess water must be driven out to produce good quality, substantially warp-free finished corrugated board 40.

It is to be understood that the names given to specific stages of a corrugating apparatus 1000 herein (i.e. "medium conditioning apparatus," "pre-corrugating web tensioner," "single-facer," "glue machine" and "double-backer") are intended merely for convenience and ease of reference for the reader, so he/she can more easily follow the present description and the associate drawings. It is in no way intended that each of these stages or 'machines' must be a single, discreet or unitary machine or device, or that specific elements (such as the pretensioning mechanisms 110 and/or 210) need to be provided together or in close association with the other elements described herein with respect to a particular stage or 'machine.' It is contemplated that various elements of the disclosed corrugating apparatus 1000 can be rearranged, or located in association with the same or different elements as herein described. For example, the medium conditioning apparatus and the pre-corrugating web tensioner as those 'machines' are described herein may be combined, with or without the same elements as described herein, or with additional cooperating elements, in a single 'machine.'

Although the invention has been described with respect to certain preferred embodiments, various modifications and changes can be made thereto by a person of ordinary skill in the art without departing from the spirit and the scope of the invention as set forth in the appended claims.

What is claimed is:

1. An apparatus for producing a corrugated product, comprising:

a zero-contact roll having an outer circumferential surface;

a pressure transducer; and a pair of corrugating rollers arranged downstream of the zero-contact roll along a web pathway for said medium material, wherein the corrugating rollers cooperate to define, at a nip therebetween, a corrugating labyrinth between respective and interlocking pluralities of corrugating teeth provided on said corrugating rollers, wherein said interlocking pluralities of corrugating teeth are effective to corrugate a web of medium material that is drawn through said nip during rotation of said corrugating rollers;

wherein said web pathway follows a path around a portion of the outer circumferential surface of said zero-contact roll and through said corrugating labyrinth between said corrugating rollers;

said zero-contact roll being operable to support said web of medium material at a variable height above its outer circumferential surface on a cushion of air that is emitted from that surface through openings provided through the outer circumferential surface of the zero-contact roll, said pressure transducer being adapted to detect a pressure of said cushion of air that supports said web above said outer circumferential surface; and said pressure transducer being operatively coupled to a feedback control loop adapted to regulate operation of a corrugating pre-tensioning mechanism to adjust a tension (T) in said web of medium material based on the pressure of said cushion of air, to thereby dampen speed and/or tension oscillations in said web on entering said corrugating labyrinth that are induced as a result of the web being drawn therein between said interlocking pluralities of corrugating teeth.

2. An apparatus according to claim 1, wherein during operation said web of medium material traveling around said zero-contact roll is free to move toward or away from said outer circumferential surface, supported on said cushion of air, in response to small increases or decreases in downstream tension demand resulting from said web being drawn through said nip and negotiating said corrugating labyrinth.

3. An apparatus according to claim 1, said zero-contact roll being effective to dampen oscillatory tension variances in the web of medium material generated as a result of that web being drawn through said nip and negotiating the corrugating labyrinth, wherein said damping is achieved passively by the height of said web above said outer circumferential surface being spontaneously adjustable in response to and at the frequency of small increases and/or decreases in downstream tension demand.

4. An apparatus according to claim 1, said zero-contact roll being a stationary roll.

5. An apparatus according to claim 1, further comprising a web conditioning apparatus effective to impart additional moisture to said web of medium material so that the web's moisture content is adjusted within a desired range prior to entering said corrugating labyrinth.

6. An apparatus according to claim 5, said web conditioning apparatus comprising a moisture application roller and a thin film metering device that is effective to provide a metered thin film of water onto a surface of said moisture application roller, said moisture application roller being disposed adjacent said web pathway so that said web, following said pathway, will be directed against said surface of said moisture application roller to transfer moisture from said thin film of water provided on said surface into said web.

7. An apparatus according to claim 5, said web conditioning apparatus comprising an electrostatically regulated water-spray system comprising a first nozzle assembly located adjacent a first side of said web pathway and a second nozzle assembly located adjacent a second side of said web pathway such that said web of medium material in operation travels in between said first and second nozzle assemblies, said first and second nozzle assemblies each being adapted to spray a fine or atomized mist of water toward the respectively adjacent outer surface of said web as it travels between said nozzle assemblies.

8. An apparatus according to claim 5, said desired range being 7-9 wt. % moisture content.

9. An apparatus according to claim 6, said moisture application roller being rotatable so that said surface thereof travels in a direction opposite that of the web of medium material at a point of contact therebetween.

10. An apparatus according to claim 6, further comprising a conditioner pre-tensioning mechanism for adjusting the tension in said web at a point where said web contacts said moisture application roller, said conditioner pre-tensioning mechanism comprising a first suction roller that is flanked by a first pair of idler rollers such that the web pathway through said conditioner pre-tensioning mechanism follows a path in contact with a surface of said first suction roller around a portion of its circumference, said first suction roller being rotatable in the same direction as, but at a slower surface linear speed than, said web traveling over its surface.

11. An apparatus according to claim 10, said first pair of idler rollers being positioned so that said web pathway contacts said surface of said first suction roller around greater than 50% of its circumference such that approaching and emerging portions of the web pathway relative and tangent to said first suction roller surface define convergent planes.

12. An apparatus according to claim 1, said corrugating pre-tensioning mechanism comprising a suction roller that is flanked by a pair of idler rollers such that the web pathway through said corrugating pre-tensioning mechanism follows a path in contact with a surface of said suction roller around a portion of its circumference, said suction roller being rotatable in the same direction as, but at a slower surface linear speed than, said web traveling over its surface.

13. An apparatus according to claim 12, said pair of idler rollers being positioned so that said web pathway contacts said surface of said suction roller around greater than 50% of its circumference such that approaching and emerging portions of the web pathway relative and tangent to said suction roller surface define convergent planes.

14. An apparatus according to claim 10, said corrugating pre-tensioning mechanism comprising a second suction roller that is flanked by a second pair of idler rollers such that the web pathway through said corrugating pre-tensioning mechanism follows a path in contact with a surface of said second suction roller around a portion of its circumference, said second suction roller being rotatable in the same direction as, but at a slower surface linear speed than, said web traveling over its surface.

15. An apparatus according to claim 14, said first and second suction rollers being independently operable at different surface linear speeds to independently adjust the tension of said web at locations where it a) is directed against said moisture application roller, and b) enters said corrugating labyrinth, respectively.

16. An apparatus according to claim 1, wherein the feedback control loop is adapted to determine the tension T in the web via the equation $T=P\times R$, wherein T is force per unit length, P is the detected pressure, and R is the radius of the zero-contact roll.

17. A method of producing a corrugated product, comprising:

a) providing an apparatus comprising:

a zero-contact roll having an outer circumferential surface;

a pressure transducer; and a pair of corrugating rollers arranged downstream of the zero-contact roll along a web pathway for said medium material, wherein the corrugating rollers cooperate to define, at a nip therebetween, a corrugating labyrinth between respective and interlocking pluralities of corrugating teeth provided on said corrugating rollers, wherein said interlocking pluralities of corrugating teeth are effective to corrugate of medium material that is drawn through said nip during rotation of said corrugating rollers;

wherein said web pathway follows a path around a portion of the outer circumferential surface of said zero-contact roll and through said corrugating labyrinth between said corrugating rollers;

said zero-contact roll being operable to support said web of medium material at a variable height above its outer circumferential surface on a cushion of air that is emitted from that surface through openings provided through the outer circumferential surface of the zero-contact roll, said pressure transducer being adapted to detect a pressure of said cushion of air that supports said web above said outer circumferential surface; and said pressure transducer being operatively coupled to a feedback control loop adapted to regulate operation of a corrugating pre-tensioning mechanism to adjust a tension (T) in said web of medium material based on the pressure of said cushion of air, to thereby dampen speed and/or tension oscillations in said web on entering said corrugating labyrinth that are induced as a result of the web being drawn therein between said interlocking pluralities of corrugating teeth;

b) emitting a volumetric flow of air from said outer circumferential surface through said holes provided in that surface;

c) feeding a web of medium material along said web pathway around a portion of said outer circumferential surface such that said web is supported on a cushion of air supplied by said volumetric flow of air, thereby supporting said web on said cushion of air at a height above said outer circumferential surface as said web travels therearound along said web pathway; and d) rotating said corrugating rollers to draw said web of medium material through said nip so that said web is forced to negotiate said corrugating labyrinth after traveling around said outer circumferential surface on said cushion of air.

18. A method according to claim 17, wherein the height of said web above the outer circumferential surface of said zero-contact roll varies spontaneously toward or away from said surface in response to small increases and decreases in downstream tension demand resulting from said web being drawn through said nip and negotiating said corrugating labyrinth.

19. A method according to claim 17, further comprising adjusting the mean tension in said web of medium material to be less than 2 pli on entry into said corrugating labyrinth.

20. A method according to claim 17, further comprising adjusting the moisture content in said web of medium material to be in the range of 7-9 wt % moisture prior to said web entering said corrugating labyrinth.

21. A method according to claim 17, further comprising adjusting the moisture content in said web of medium material to be in the range of 7-8 wt % moisture prior to said web entering said corrugating labyrinth.

22. A method according to claim 17, wherein no steam heat is used to raise the temperature of said web of medium material prior to said web entering said corrugating labyrinth.

23. A method according to claim 22, wherein no steam heat is used to raise the temperature of said corrugating rollers.

24. A method according to claim 17, said method being carried out to produce a double-faced corrugated product from said web of medium material, which is initially un-corrugated, and two additional webs of un-corrugated material, entirely under ambient temperature conditions without the application of heat.

25. A method according to claim 24, wherein a high-solids-content adhesive is used to glue the two additional webs of un-corrugated material to opposing sides of said web of medium material after it is corrugated in said corrugating labyrinth.

26. A method according to claim 25, said high-solids content adhesive comprising at least 40 wt. % solids.

27. A method according to claim 25, said high-solids content adhesive having a viscosity of 15-55 Stein-Hall seconds.

28. A method according to claim 20, wherein the moisture content in said web is adjusted in said range by providing a precisely metered thin film of water onto a surface of a moisture application roller, and conveying said web past and against said surface thereof so that moisture from said thin film is transferred into said web.

29. A method according to claim 20, wherein the moisture content in said web is adjusted in said range by directing a fine or atomized water mist toward said web via electrostatic forces at a location upstream of said corrugating labyrinth, such that at least a portion of the mist directed toward said web is absorbed by said web.

30. A method according to claim 17, said method being carried out entirely at or near room temperature to produce a double-faced corrugated product that includes said web of medium material, which is initially un-corrugated, wherein the web of medium material is substantially fracture-free after being corrugated in the corrugating labyrinth.

31. A method according to claim 17, further comprising adjusting said volumetric flow of air so that said height is 0.2-0.5 inch.

32. A method according to claim 17, further comprising adjusting said volumetric flow of air so that said height is 0.025-0.1 inch.

33. A method according to claim 20, wherein no steam heat is used to raise the temperature of said web of medium material prior to said web entering said corrugating labyrinth.

34. A method according to claim 32, wherein no steam heat is used to raise the temperature of said corrugating rollers.

* * * * *

UNITED STATES PATENT AND TRADEMARK OFFICE

CERTIFICATE OF CORRECTION

PATENT NO. : 8,057,621 B2
APPLICATION NO. : 11/279347
DATED : November 15, 2011
INVENTOR(S) : Herbert B. Kohler It is certified that error appears in the above-identified patent and that said Letters Patent is hereby corrected as shown below:

Col. 8, Line 12, insert the following between the words "understood" and "regulating":
--that the degree of moisture application can be controlled in this embodiment by--.

Col. 9, Line 32, replace "fpi" with "pli".

Claim 34, at Col. 22, Line 20, the claim should depend from claim 33, not claim 32.

Signed and Sealed this
Third Day of April, 2012

David J. Kappos

David J. Kappos
*Director of the United States Patent and Trademark Office*